US010660452B2

(12) United States Patent
Cartisano

(10) Patent No.: US 10,660,452 B2
(45) Date of Patent: May 26, 2020

(54) PROTECTOR FOR FURNITURE HAVING A SEAT

(71) Applicant: P. Kaufmann, Inc., New York, NY (US)

(72) Inventor: Nancyann Cartisano, New York, NY (US)

(73) Assignee: P. KAUFMANN, INC., New York, NY (US)

( * ) Notice: Subject to any disclaimer, the term of this patent is extended or adjusted under 35 U.S.C. 154(b) by 1 day.

(21) Appl. No.: 16/119,449

(22) Filed: Aug. 31, 2018

(65) Prior Publication Data

US 2020/0069071 A1 Mar. 5, 2020

(51) Int. Cl.
*A47C 31/00* (2006.01)
*A47C 31/11* (2006.01)

(52) U.S. Cl.
CPC ..... *A47C 31/11* (2013.01)

(58) Field of Classification Search
CPC . A47C 31/11; B60N 2/58; B60N 2/60; B60N 2/6018
See application file for complete search history.

(56) References Cited

U.S. PATENT DOCUMENTS

| | | | | |
|---|---|---|---|---|
| 2,086,640 | A * | 7/1937 | Reynolds | A47C 31/11 297/218.1 |
| 2,313,878 | A | 3/1943 | Kline | |
| 2,833,341 | A * | 5/1958 | Bornstein | B60N 2/7005 297/229 |
| 3,311,408 | A * | 3/1967 | Sarvas | A47C 31/11 297/218.3 |
| 5,326,150 | A * | 7/1994 | Robinson | B60N 2/5891 297/218.2 |
| 5,547,249 | A | 8/1996 | Riley et al. | |
| 7,431,394 | B2 | 10/2008 | Neustat | |
| 8,393,675 | B2 | 3/2013 | Swanson | |
| 8,733,837 | B2 | 5/2014 | Weinstein | |
| 9,603,462 | B2 | 3/2017 | Markowitz | |
| 9,863,159 | B2 * | 1/2018 | Wiseman | E04H 4/101 |
| 2014/0265483 | A1 | 9/2014 | Miller | |
| 2017/0156509 | A1 | 6/2017 | Markowitz | |
| 2017/0328079 | A1 * | 11/2017 | Wiseman | E04H 4/101 |

* cited by examiner

*Primary Examiner* — Shin H Kim
(74) *Attorney, Agent, or Firm* — Marvin Petry; Stites & Harbison PLLC

(57) ABSTRACT

A protector or a furniture item having a seat with cushions, a back and arms. At the junctions of the seat panel with arm and back panels, a flap connected to these junctions extends downwardly to approximately the bottom of the cushions wherein an enlarged loop with a rod therein secures the protector in place.

10 Claims, 4 Drawing Sheets

PROTECTOR FOR FURNITURE HAVING A SEAT

FIELD OF THE INVENTION

This invention relates to a protector to be placed over the surfaces of a furniture item having a seat including cushions.

BACKGROUND OF THE INVENTION

It is known of course to provide a protector to protect the surfaces of furniture items having seats such as a chair, sofa or couch of any length.

Problems associated with prior furniture protectors include shifting from their desired optimal position, or falling off or being inadvertently knocked off the furniture item.

The present invention provides a new and improved furniture protector which is securely held on the furniture item and thereby solves the above noted and other problems associated with prior unsecured or less secured furniture protectors.

SUMMARY OF THE INVENTION

The present invention provides a protector for furniture having a seat which protector is secured in place.

At the junction where a seat panel joins a back panel and/or arm panels, there is provided a flap which extends downwardly and includes at the bottom thereof, a rod is formed as a cylinder in a loop formed at the bottom of the flap with the cylinder, preferably of a foam material.

The protector is placed loosely over the furniture item with the arm and back panels turned inwardly onto the seat panel to expose the junctions where the flaps are attached. The flaps with their rods at their bottoms are then pushed down between the seat cushion and the arm or back of the furniture item to secure the protector in place. This also smoothes out the seat of the furniture item.

Objects and advantages of the invention will be apparent from the detailed description to follow.

BRIEF DESCRIPTION OF THE DRAWINGS

There follows a detailed description of the preferred embodiments of the invention, to be read together with the accompanying drawings, wherein.

DETAILED DESCRIPTION OF THE PREFERRED EMBODIMENTS

Preferred embodiments of the present invention will now be described with reference to the drawings, wherein like elements are represented by like numerals throughout the several views.

Figure 1:
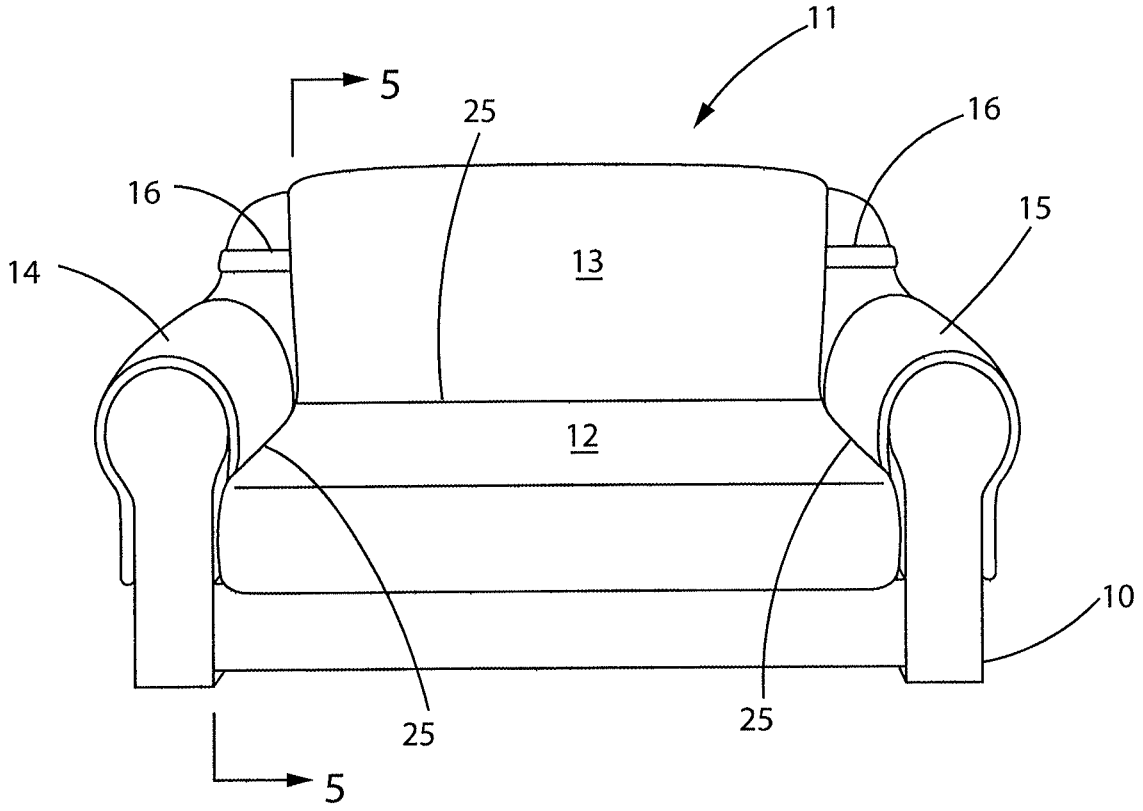
FIG. 1 is a front perspective view of a furniture item having a seat, in this case a sofa, having the furniture protector of the present invention mounted thereon.

FIG. 1 illustrates a protector 11 in use on a loveseat 10. It is understood that the invention is applicable to any seating furniture having a back and arms including for example a chair, a sofa, a couch of any length, including winged back chairs and recliners.

The protector 11 is a single piece of material including a seat panel 12, a back panel 13 and arm panels 14 and 15. The back panel and the arm panels are joined to the seat panel at junctions 25 where these panels turn upwardly from the seat panel. The back panel 13 extends up and over the top of the back of the seating furniture and is secured to the seating furniture by an elastic strap 16 which is sewn at one end to the side of the back panel 13 lying over the front of the furniture item and the portion of the back panel located up and over the top of the back of the seating furniture.

Figure 2:
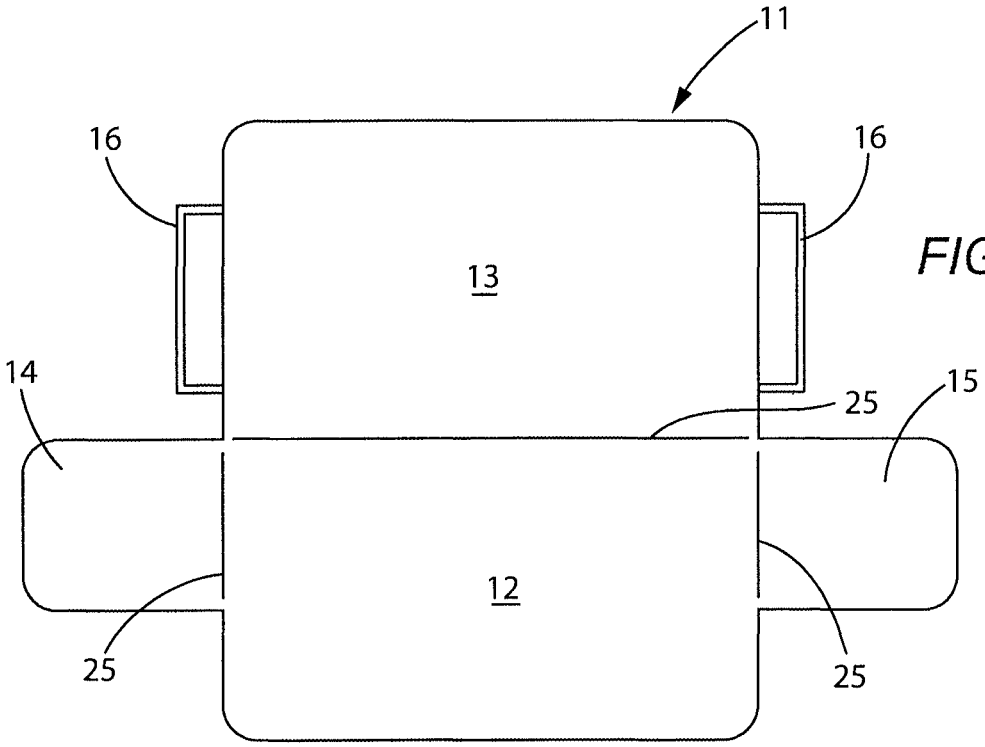
FIG. 2 is a top plan view of the furniture protector laid out flat and showing the outer surfaces which would be exposed when the furniture protector is in place on a furniture item.

FIG. 2 shows the protector 11 laid out flat and showing the junctions at which the panels 13, 14, 15 join the seat panel 12 and showing the elastic strap 16 connected to the back panel 13 at two locations, one ending up on the front and one on the rear side of the back of the seating furniture.

Figure 3:
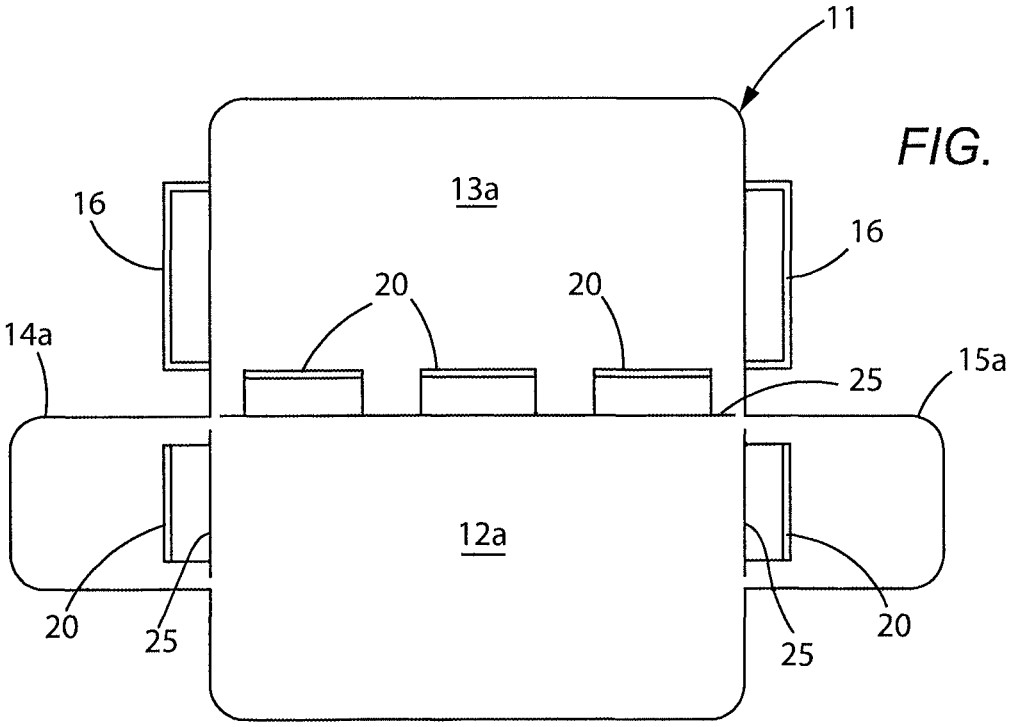
FIG. 3 is a bottom plan view of the furniture protector showing the surfaces which would not be visible when the furniture protector is in place on the furniture item.

FIG. 3 is a bottom plan view of the protector of the present invention showing the bottom, i.e., the surfaces which engage the surface of the furniture item. For this reason, the panels are given a subscript a, i.e., 12*a*-15*a*. FIG. 3 shows flaps 20 which are connected to the protector on the bottom thereof at the junctions 25 where the seat panel joins the arm and back panels.

Figure 4:
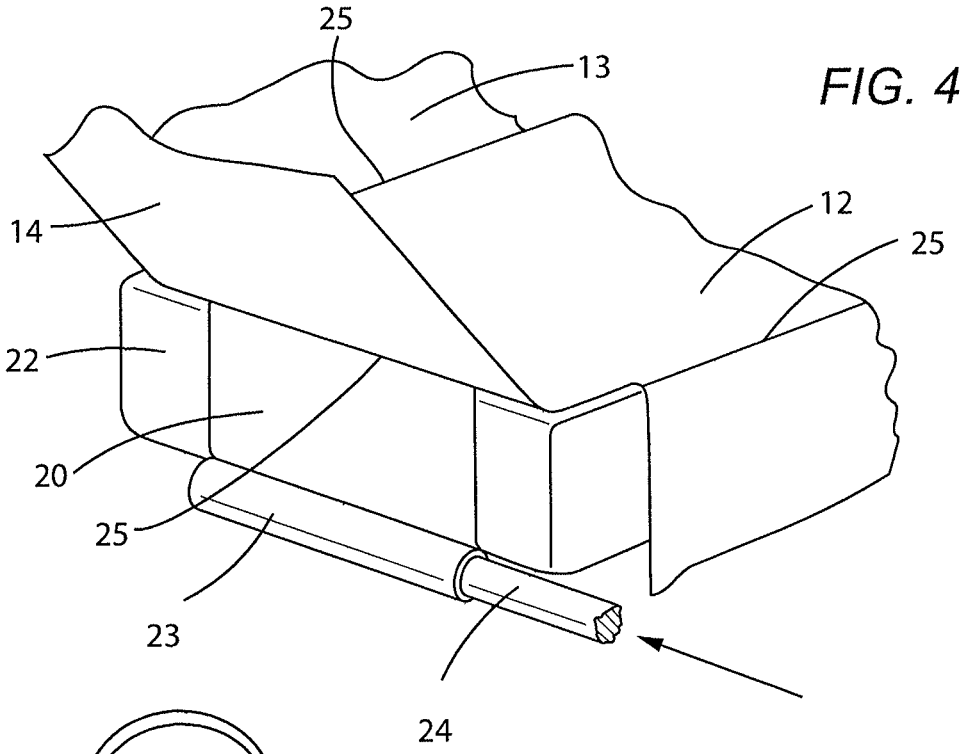
FIG. 4 is an enlarged perspective view showing a portion of the invention.

Referring first to FIG. 4, there is shown a flap 20 in relation to seat a cushion 22. The top of the flap 20 is sewn to the protector 11 at a junction 25 between the seat panel and an arm or back panel. The flap 20 extends downwardly for a suitable distance to perform its function. Currently flaps extend approximately 6 to 8 inches. However, this length can vary since it depends on the thickness of the cushions and also whether the flaps should extend down to the bottom of the cushion, i.e., greater than the thickness of the cushion. The length can vary depending on many factors, so long as in a given case it performs its function of securing the seat panel to the furniture item.

At its lower end the flap 20 is enlarged, by a loop with a cylinder passing there through. The loop can preferably be formed by the material of the flap 20 being turned 180° at its lower end and then sewn to itself to form the loop.

A cylinder 24 is inserted into the loop to form the rod which anchors in the vicinity at the bottom corner of the cushion where it engages the inside of the arm or back of the furniture item in the area at the bottom of the cushion. So long as the anchoring function is achieved, the rod may be located either at the bottom of the cushion or in the vicinity thereof.

The cylinder 24 would preferably be made of a soft material such as foam, often referred to as a "noodle", although any material could be used.

Figure 5:
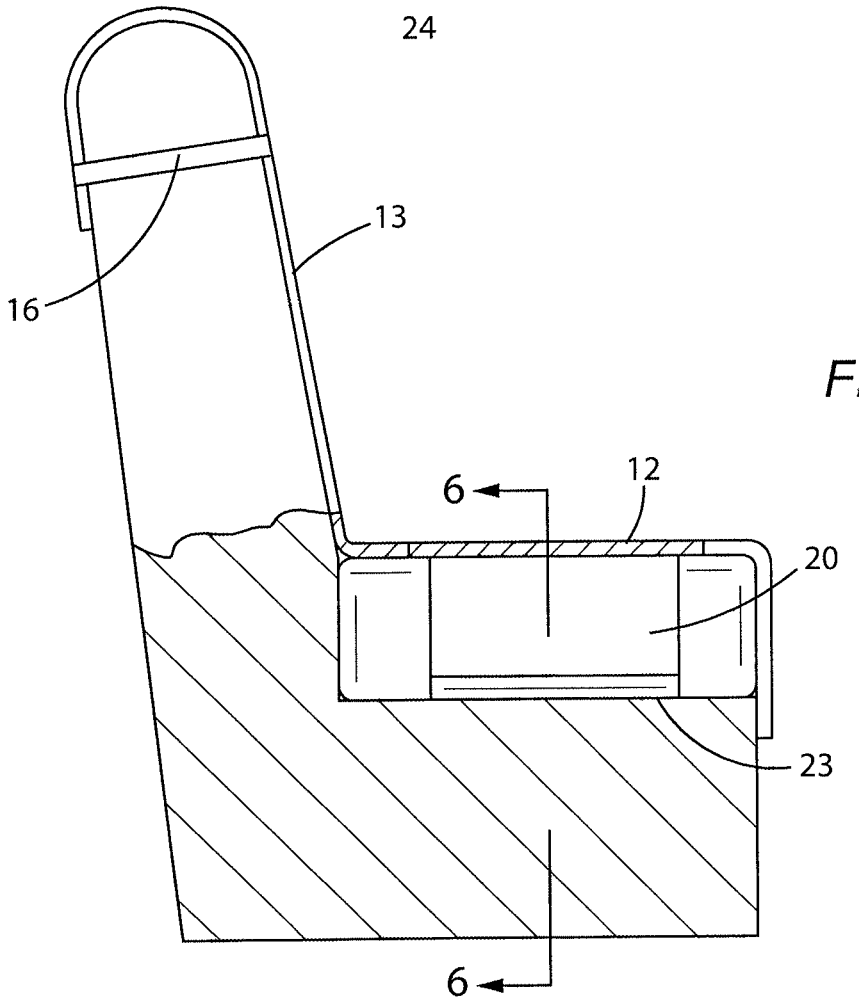
FIG. 5 is a cross sectional view taken along line 5-5 of FIG. 1.
Figure 6:
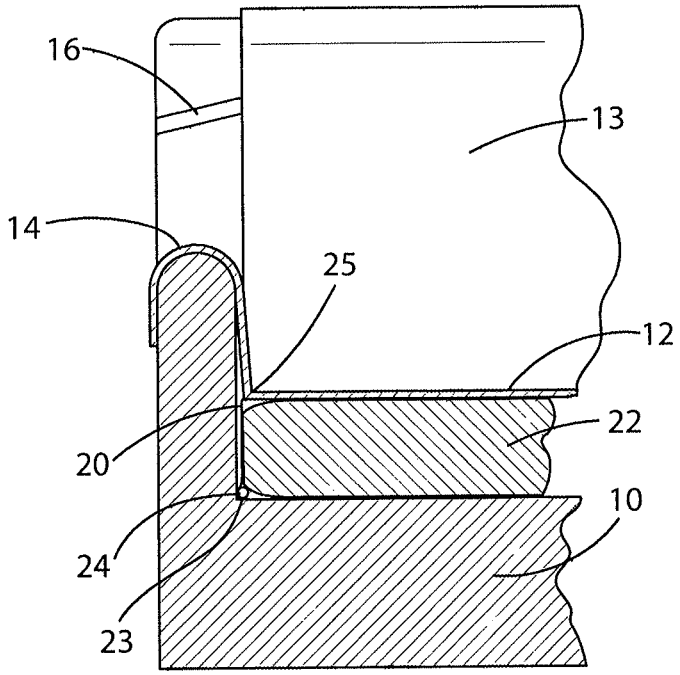
FIG. 6 is a partial cross sectional view taken along line 6-6 of FIG. 5.
Figure 7:
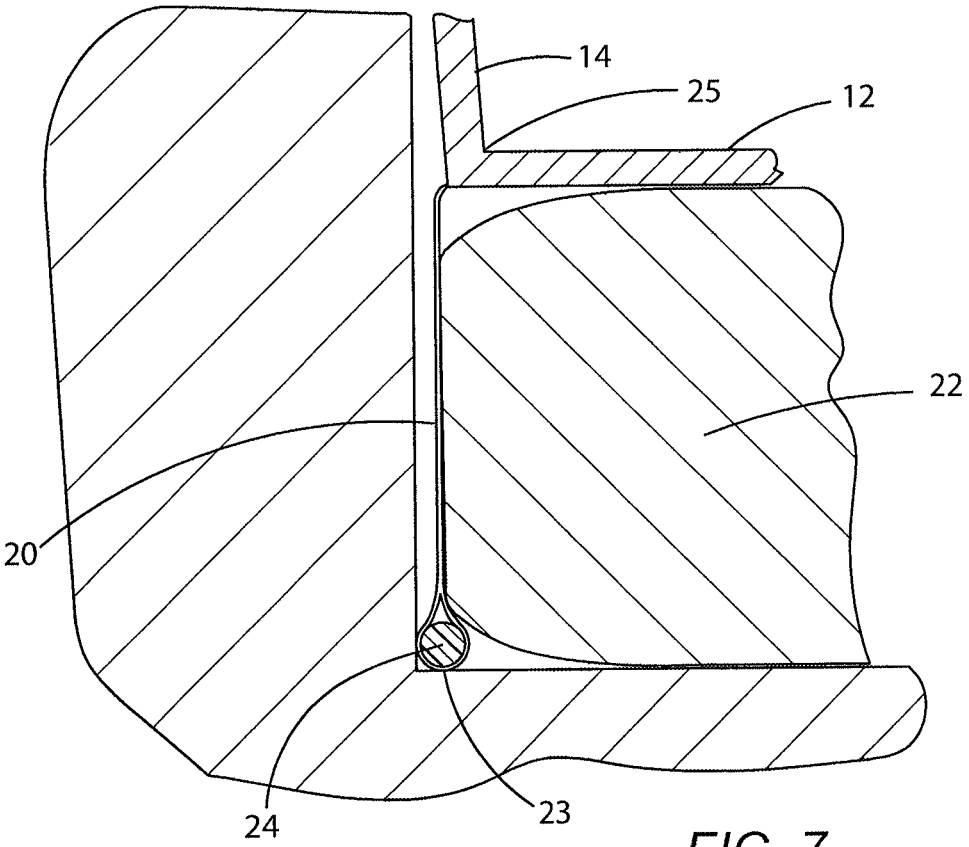
FIG. 7 is a partial sectional view taken in the same plane as FIG. 5 but enlarged to better show features of the invention.

FIGS. 5-7 illustrate the relationship of the cushion 22, seat panel 12, arm and back panels 14 and 15, junction 25, flap 20, loop 23 and rod 24, with FIG. 7 being a view similar to FIG. 6 but enlarged in order to better bring out the relevant details of the present invention.

While the dimensions of the flaps and rod may vary, it has been found suitable to use flaps having a height of 6 to 8 inches and a width of 18 inches.

With these dimensions, there would normally be only one flap for each arm panel and any number of flaps along the back of the seat panel depending on the width of the seat, i.e., whether a chair, a sofa, a couch or a recliner.

In the use of protector of the present invention, the single piece of material as shown in FIGS. 2 and 3 would first have rods with cylinders inserted into the loops of all of the flaps 20 after which the protector would be thrown loosely over the furniture item with the back and arm panels turned inwardly to expose the flaps with their rods which would then be engaged to push the flap and their rods down into the space between the back and arms to a level approximately at the bottom of the cushions. Movement of the flaps in this manner will tend to smooth out the seat and prevents the protector from becoming loose. With the flaps and rods firmly in place, the last step is to drape the arm and back panels up and over the arm and back of the furniture item, respectively, and preferably securing the back panel with the elastic straps 16, as shown in FIG. 1.

Although the flaps could be of any suitable size, in one preferred arrangement they are 6 to 8 inches in height. They may be formed using a material having a height of 10 inches with the bottom forming a loop so that the height of the entire flap and loop would be approximately 6 to 8 inches, although of course this will vary, depending on the thickness of the cushion. The height of the flap could vary since in practice the flap and rod could accomplish its securing function either at the bottom of the cushion or at a higher point between the cushion and the back and/or the arms of the furniture item. For a typical furniture item, the elastic straps could preferably be secured to the back panel 8 inches from the top thereof and 12 inches from the bottom thereof.

Although the invention has been described in detail with respect to a preferred embodiment, it is to be understood that the invention is capable of numerous modifications and variations, apparent to those skilled in the art, without departing from the spirit and scope of the invention.

The invention claimed is:

1. A protector for a furniture item having a seat with at least one cushion, a back and arms, comprising:

a seat panel configured to cover at least one seat cushion of the furniture item, a back panel configured to cover the back of the furniture item and arm panels configured to cover the arms of the furniture item, the protector panels having bottom surfaces which in use engage the furniture item and top surfaces which in use face outwardly from the furniture item, a flap connected to a junction of at least one of the seat panel and back panel and/or the seat panel and the arm panels, the flap being generally flat and extending downwardly from the bottom of said junction, an elongated rod attached to the lower end of the flap and extending generally horizontally between the inside of the arm and/or back and the at least one seat cushion, the cross section of the rod being such that the rod engages both the at least one seat cushion and the arm or back with sufficient contact to resist movement of the rod upwardly out of engagement with the arm and/or back and the at least one seat cushion in order to secure the protector in place on the furniture item.

2. The protector according to claim 1, wherein the rod is formed by a cylinder within a loop formed in the lower end of the flap securing the cylinder.

3. The protector according to claim 2, wherein the cylinder is formed of a foam material.

4. The protector according to claim 2, wherein a flap is provided for each of the arm and for the back.

5. The protector according to claim 4, wherein the furniture item is wider than a chair and includes a plurality of flaps located along the length of the back.

6. The protector according to claim 1, wherein the flap or flaps are formed by a length of material having said loop formed at its lower end by turning up the material of the flap and the cylinder located in the loop.

7. The protector according to claim 1, wherein the furniture item is a chair and includes a single flap for each arm and for the back.

8. The protector according to claim 1, including an elastic strap securing the back panel to the back of the furniture item.

9. The protector according to claim 1, wherein the flaps are of a size to place the rod in the vicinity of the bottom of the cushion.

10. The protector according to claim 1, wherein the flap is of a size to place the rod above the bottom of the cushion.

* * * * *